US010174750B2

(12) United States Patent
Roberts et al.

(10) Patent No.: US 10,174,750 B2
(45) Date of Patent: Jan. 8, 2019

(54) DIAPHRAGM PUMPS WITH AIR SAVINGS DEVICES

(71) Applicant: Ingersoll-Rand Company, Davidson, NC (US)

(72) Inventors: Jevawn Sebastian Roberts, Atlanta, GA (US); Michael Brace Orndorff, Douglasville, GA (US)

(73) Assignee: Ingersoll-Rand Company, Davidson, NC (US)

( * ) Notice: Subject to any disclaimer, the term of this patent is extended or adjusted under 35 U.S.C. 154(b) by 0 days.

(21) Appl. No.: 15/493,820

(22) Filed: Apr. 21, 2017

(65) Prior Publication Data

US 2017/0226997 A1 Aug. 10, 2017

Related U.S. Application Data

(62) Division of application No. 14/316,780, filed on Jun. 26, 2014, now Pat. No. 9,664,186.

(60) Provisional application No. 61/839,703, filed on Jun. 26, 2013, provisional application No. 61/895,796, filed on Oct. 25, 2013.

(51) Int. Cl.

| | |
|---|---|
| ***F04B 43/073*** | (2006.01) |
| ***F04B 45/04*** | (2006.01) |
| ***F04B 45/053*** | (2006.01) |
| ***F04B 43/02*** | (2006.01) |
| ***F04B 49/22*** | (2006.01) |

(52) U.S. Cl.

CPC ..... *F04B 43/073* (2013.01); *F04B 43/025* (2013.01); *F04B 43/026* (2013.01); *F04B 45/043* (2013.01); *F04B 45/0536* (2013.01); *F04B 49/22* (2013.01)

(58) Field of Classification Search

CPC ..... F04B 9/129; F04B 9/133; F04B 23/06; F04B 41/06; F04B 43/025–43/026; F04B 43/073; F04B 43/0736; F04B 45/043; F04B 45/0536; F04B 49/22

USPC ..... 417/384, 385, 386, 392, 393, 395

See application file for complete search history.

(56) References Cited

U.S. PATENT DOCUMENTS 3,548,716 A * 12/1970 Rayl ..... F01L 25/063 417/393
3,838,946 A * 10/1974 Schall ..... F01L 15/08 417/393
4,334,837 A * 6/1982 Inada ..... F04B 45/043 417/393

(Continued)

*Primary Examiner* — Alexander Comley
(74) *Attorney, Agent, or Firm* — Jones IP Group; Wayne A. Jones

(57) ABSTRACT

In at least one illustrative embodiment, a diaphragm pump includes a sleeve formed to include (i) a bore extending along a longitudinal axis and (ii) a sleeve port that opens to the bore, and a spool supported in the bore of the sleeve and formed to include a spool port, the spool being configured to move with a diaphragm during at least a portion of a stroke of the diaphragm such that the spool slides relative to the sleeve and, when the diaphragm reaches a turndown position that is between first and second end-of-stroke positions, the spool port aligns with the sleeve port to cause a pilot signal to be supplied to a cut-off valve. At least one of the sleeve and the spool may be rotatable about the longitudinal axis to adjust a location of the turndown position relative to the first and second end-of-stroke positions.

8 Claims, 7 Drawing Sheets

(56) References Cited

U.S. PATENT DOCUMENTS 4,381,180 A * 4/1983 Sell ..... F04B 43/0736 137/625.27
4,386,888 A * 6/1983 Verley ..... B67D 1/103 417/393
4,854,832 A * 8/1989 Gardner ..... F01L 25/063 417/393
5,232,352 A * 8/1993 Robinson ..... F04B 43/0736 417/393
5,277,555 A * 1/1994 Robinson ..... F01L 25/063 137/625.37
5,326,234 A * 7/1994 Versaw ..... F01L 25/063 417/393
5,551,847 A * 9/1996 Gardner ..... F01L 25/063 251/77
5,996,627 A * 12/1999 Reynolds ..... F04B 43/0736 137/625.6
6,004,105 A * 12/1999 Reynolds ..... F04B 43/0736 417/386
6,036,445 A * 3/2000 Reynolds ..... F04B 43/0736 417/395
6,158,465 A * 12/2000 Lambert ..... F01L 1/34 137/625.16
6,241,487 B1 * 6/2001 Reynolds ..... F04B 43/0736 137/625.6
6,619,932 B2 * 9/2003 Murata ..... F04B 43/0736 417/392
7,517,199 B2 * 4/2009 Reed ..... F04B 43/0736 417/395
7,811,067 B2 * 10/2010 Dietzsch ..... F04B 43/0736 137/556
8,167,586 B2 * 5/2012 Towne ..... F04B 43/0736 137/596.14
2004/0047749 A1 * 3/2004 Roberts ..... F04B 43/0736 417/395
2005/0031467 A1 * 2/2005 Caldwell ..... F04B 43/0736 417/395
2005/0281688 A1 * 12/2005 Towne ..... F04B 43/067 417/395
2007/0092386 A1 * 4/2007 Reed ..... F04B 43/0736 417/395
2008/0187449 A1 * 8/2008 Breidenbach ..... F04B 7/06 417/499
2009/0202361 A1 * 8/2009 Reed ..... F04B 43/0736 417/46
2010/0189577 A1 * 7/2010 McCourt ..... F04B 43/0081 417/293
2010/0247334 A1 * 9/2010 Simmons ..... F04B 27/005 417/53
2011/0142692 A1 * 6/2011 Roseberry ..... F04B 9/135 417/395

* cited by examiner

DIAPHRAGM PUMPS WITH AIR SAVINGS DEVICES

RELATED APPLICATION

This application is a Division of U.S. patent application Ser. No. 14/316,780 filed Jun. 26, 2014, entitled "Diaphragm Pumps with Air Savings Devices." This application also claims the benefit of U.S. Provisional Patent Application No. 61/839,703, filed Jun. 26, 2013, and U.S. Provisional Patent Application No. 61/895,796, filed Oct. 25, 2013 (both entitled "Energy Efficiency Enhancements for Air Operated Diaphragm Pumps"). The entire disclosures of both of the foregoing applications are incorporated by reference herein.

TECHNICAL FIELD

The present disclosure relates, generally, to diaphragm pumps and, more particularly, to diaphragm pumps with air savings devices.

BACKGROUND

Double diaphragm pumps alternately pressurize and exhaust two opposing motive fluid chambers to deliver pumped media during each stroke of the pump. Pressurizing the motive fluid chambers often results in operating efficiency losses as some of the motive fluid communicated to the chambers during each stroke does not contribute to the pumping action. In an attempt to mitigate this shortcoming, some prior pumps have interrupted the supply of motive fluid using devices having electrical components. Such pumps, however, may have limited utility in industrial applications where the use of electrical components necessitates safety measures that are not typically required for purely mechanical devices.

SUMMARY

According to one aspect, a diaphragm pump may comprise a first diaphragm that separates a first cavity into a first motive fluid chamber and a first pumped media chamber, where the first diaphragm is configured to stroke from a first end-of-stroke position to a second end-of-stroke position in response to compressed fluid being communicated from a compressed fluid inlet to the first motive fluid chamber. The diaphragm pump may further comprise a cut-off valve configured to communicate compressed fluid from the compressed fluid inlet to the first motive fluid chamber in response to receiving a first pilot signal and resist communication of compressed fluid from the compressed fluid inlet to the first motive fluid chamber in response to receiving a second pilot signal. The diaphragm pump may further comprise a sleeve formed to include (i) a bore extending along a longitudinal axis and (ii) a first sleeve port that opens to the bore, where the first sleeve port is fluidly coupled to the cut-off valve via a pilot line. The diaphragm pump may further comprise a spool supported in the bore of the sleeve and formed to include a first spool port, where the spool is configured to move with the first diaphragm during at least a portion of the stroke of the first diaphragm such that the spool slides relative to the sleeve and, when the first diaphragm reaches a turndown position that is between the first and second end-of-stroke positions, the first spool port aligns with the first sleeve port to cause the second pilot signal to be supplied to the cut-off valve via the pilot line. At least one of the sleeve and the spool may be rotatable about the longitudinal axis to adjust a location of the turndown position relative to the first and second end-of-stroke positions.

In some embodiments, the first sleeve port may include a sidewall disposed at an acute angle to a circumference of the sleeve. The diaphragm pump may further comprise a housing defining the first cavity and supporting the sleeve. The housing may be formed to include a first keyed feature, and the spool may be formed to include a second keyed feature, where the first keyed feature is configured to mate with the second keyed feature to resist rotation of the spool about the longitudinal axis.

In some embodiments, the sleeve may be further formed to include (i) a second sleeve port that opens to the bore and (ii) a third sleeve port that opens to the bore. The spool may be further formed to include a spool groove in an outer surface of the spool. The spool may also be configured to move with the first diaphragm during at least a portion of the stroke of the first diaphragm such that, when the first diaphragm reaches the second end-of-stroke position, the spool groove fluidly couples the second sleeve port to the third sleeve port to cause the first pilot signal to be supplied to the cut-off valve via the pilot line.

In some embodiments, the spool may be further formed to include a passageway extending parallel to the longitudinal axis between the first spool port and an end of the spool that extends into the first motive fluid chamber, such that the first spool port is fluidly coupled to the first motive fluid chamber at least when the first diaphragm is in the turndown position. The second sleeve port may be fluidly coupled to an exhaust chamber. The first pilot signal may comprise a pressure that does not exceed a threshold. The second pilot signal may comprise a pressure that exceeds the threshold.

In other embodiments, the first spool port may be fluidly coupled to an exhaust chamber at least when the first diaphragm is in the turndown position. The second sleeve port may be fluidly coupled to the compressed fluid inlet. The first pilot signal may comprise a pressure that exceeds a threshold. The second pilot signal may comprise a pressure that does not exceed the threshold.

In some embodiments, the diaphragm pump may further comprise a second diaphragm that separates a second cavity into a second motive fluid chamber and a second pumped media chamber, where the second diaphragm is coupled to the first diaphragm such that the second diaphragm is configured to move reciprocally with the first diaphragm between the first and second end-of-stroke positions, and where the second diaphragm is further configured to stroke from the second end-of-stroke position to first end-of-stroke position in response to compressed fluid being communicated from the compressed fluid inlet to the second motive fluid chamber. The sleeve may be further formed to include a second sleeve port that opens to the bore, the second sleeve port being fluidly coupled to the cut-off valve via the pilot line. The spool may be further formed to include a second spool port, where the spool is also configured to move with the second diaphragm during at least a portion of the stroke of the second diaphragm such that the spool slides relative to the sleeve and, when the second diaphragm reaches the turndown position that is between the first and second end-of-stroke positions, the second spool port aligns with the second sleeve port to cause the second pilot signal to be supplied to the cut-off valve via the pilot line.

In some embodiments, the spool may couple the second diaphragm to the first diaphragm such that the second diaphragm is configured to move reciprocally with the first diaphragm between the first and second end-of-stroke positions. The second diaphragm may engage the spool during at least a portion of the stroke of the first diaphragm to cause the spool to slide relative to the sleeve. The first diaphragm may engage the spool during at least a portion of the stroke of the second diaphragm to cause the spool to slide relative to the sleeve. The spool may be further formed to include (i) a first passageway extending parallel to the longitudinal axis between the first spool port and a first end of the spool that extends into the first motive fluid chamber, such that the first spool port is fluidly coupled to the first motive fluid chamber at least when the first and second diaphragms are in the turndown position, and (ii) a second passageway extending parallel to the longitudinal axis between the second spool port and a second end of the spool that extends into the second motive fluid chamber, such that the second spool port is fluidly coupled to the second motive fluid chamber at least when the first and second diaphragms are in the turndown position.

According to another aspect, a diaphragm pump may comprise a diaphragm that separates a cavity into a motive fluid chamber and a pumped media chamber, where the diaphragm is configured to stroke from a first end-of-stroke position to a second end-of-stroke position in response to compressed fluid being communicated from a compressed fluid inlet to the motive fluid chamber. The diaphragm pump may further comprise a cut-off valve configured to communicate compressed fluid from the compressed fluid inlet to the motive fluid chamber in response to receiving a first pilot signal and resist communication of compressed fluid from the compressed fluid inlet to the motive fluid chamber in response to receiving a second pilot signal. The diaphragm pump may further comprise a sleeve formed to include a bore extending along a longitudinal axis, a first sleeve port that opens to the bore, and a second sleeve port that opens to the bore, where the second sleeve port being fluidly coupled to the cut-off valve via a pilot line. The diaphragm pump may further comprise a spool supported in the bore of the sleeve and formed to include a spool groove in an outer surface of the spool, where the spool is configured to move with the diaphragm during at least a portion of the stroke of the diaphragm such that the spool slides relative to the sleeve and, when the diaphragm reaches a turndown position that is between the first and second end-of-stroke positions, the spool groove fluidly couples the first sleeve port to the second sleeve port to cause the second pilot signal to be supplied to the cut-off valve via the pilot line. At least one of the sleeve and the spool may be rotatable about the longitudinal axis to adjust a location of the turndown position relative to the first and second end-of-stroke positions.

In some embodiments, the sleeve may be further formed to include a third sleeve port that opens to the bore. The second sleeve port may be positioned between the first and third sleeve ports along the longitudinal axis. The spool may also be configured to move with the diaphragm during at least a portion of the stroke of the diaphragm such that, when the diaphragm reaches the second end-of-stroke position, the spool groove fluidly couples the third sleeve port to the second sleeve port to cause the first pilot signal to be supplied to the cut-off valve via the pilot line. The first sleeve port may be fluidly coupled to the compressed fluid inlet. The third sleeve port may be fluidly coupled to an exhaust chamber. The first pilot signal may comprise a pressure that does not exceed a threshold. The second pilot signal may comprise a pressure that exceeds the threshold. The first sleeve port may be fluidly coupled to an exhaust chamber. The third sleeve port may be fluidly coupled to the compressed fluid inlet. The first pilot signal may comprise a pressure that exceeds a threshold. The second pilot signal may comprise a pressure that does not exceed the threshold. The second sleeve port may include a sidewall disposed at an acute angle to a circumference of the sleeve. The spool groove may include a sidewall disposed at an acute angle to a circumference of the spool.

According to yet another aspect, a diaphragm pump may comprise a diaphragm that separates a cavity into a motive fluid chamber and a pumped media chamber, where the diaphragm is configured to stroke from a first end-of-stroke position to a second end-of-stroke position in response to compressed fluid being communicated from a compressed fluid inlet to the motive fluid chamber. The diaphragm pump may further comprise a cut-off valve configured to communicate compressed fluid from the compressed fluid inlet to the motive fluid chamber in response to receiving a first pilot signal and resist communication of compressed fluid from the compressed fluid inlet to the motive fluid chamber in response to receiving a second pilot signal. The diaphragm pump may further comprise a sleeve formed to include a bore extending along a longitudinal axis and a plurality of sleeve ports spaced apart along the longitudinal axis, where a selected one of the plurality of sleeve ports is configured to provide fluid communication between the bore and a pilot line fluidly coupled to the cut-off valve, and where all but the selected one of the plurality of sleeve ports are blocked to resist fluid communication between the bore and the pilot line. The diaphragm pump may further comprise a spool supported in the bore of the sleeve and formed to include a spool port, where the spool is configured to move with the diaphragm during at least a portion of the stroke of the diaphragm such that the spool slides relative to the sleeve and, when the diaphragm reaches a turndown position that is between the first and second end-of-stroke positions, the spool port aligns with the selected one of the plurality of sleeve ports to cause the second pilot signal to be supplied to the cut-off valve via the pilot line. In some embodiments, a location of the turndown position relative to the first and second end-of-stroke positions is dependent upon which of the plurality of sleeve ports is selected.

In some embodiments, a plurality of removable plugs may be positioned in all but the selected one of the plurality of sleeve ports. The diaphragm pump may further comprise a manifold slidable relative to the sleeve along the longitudinal axis, the manifold being configured to cover all but the selected one of the plurality of sleeve ports.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

DETAILED DESCRIPTION OF THE DRAWINGS

Figure 1:
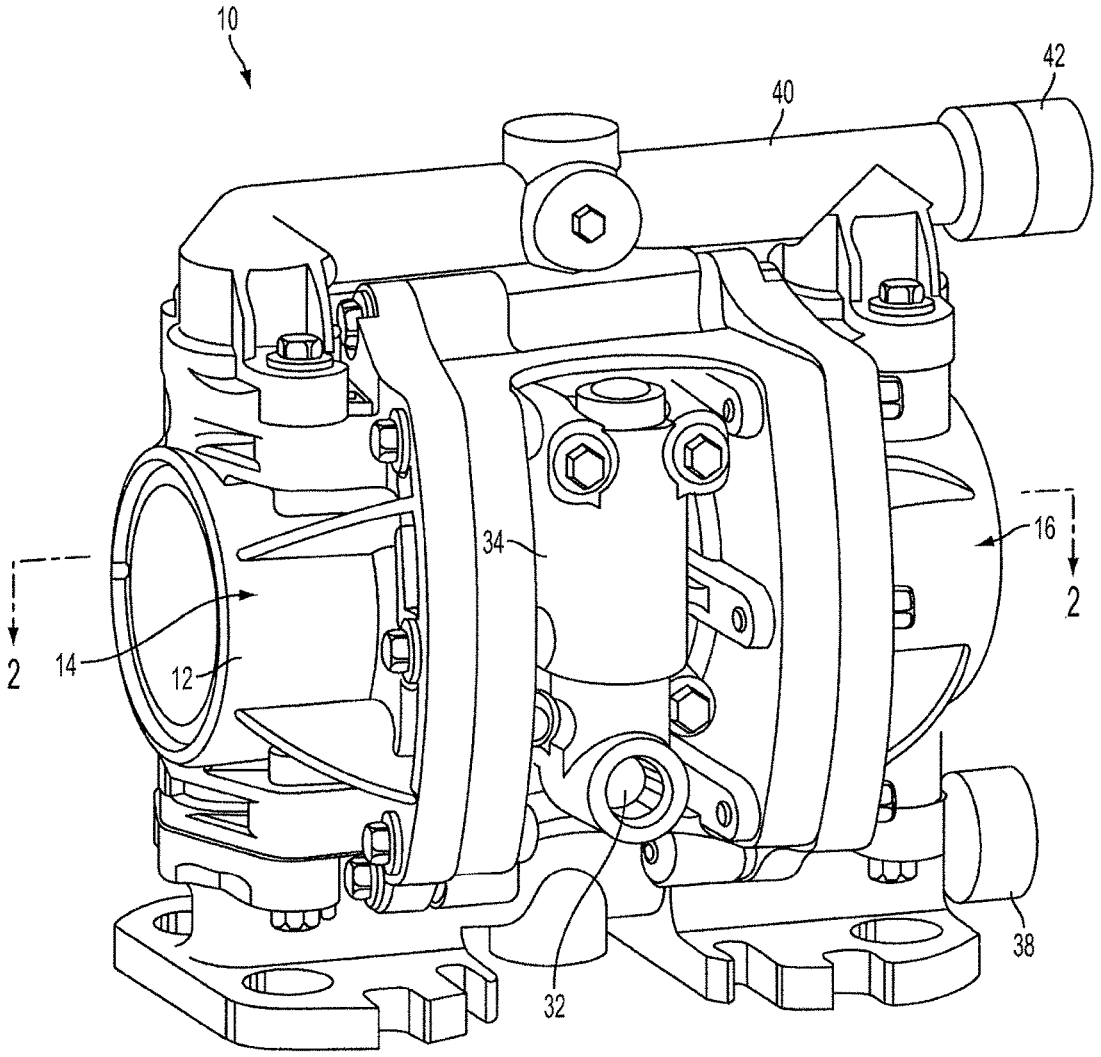
FIG. 1 is a perspective view of one illustrative embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
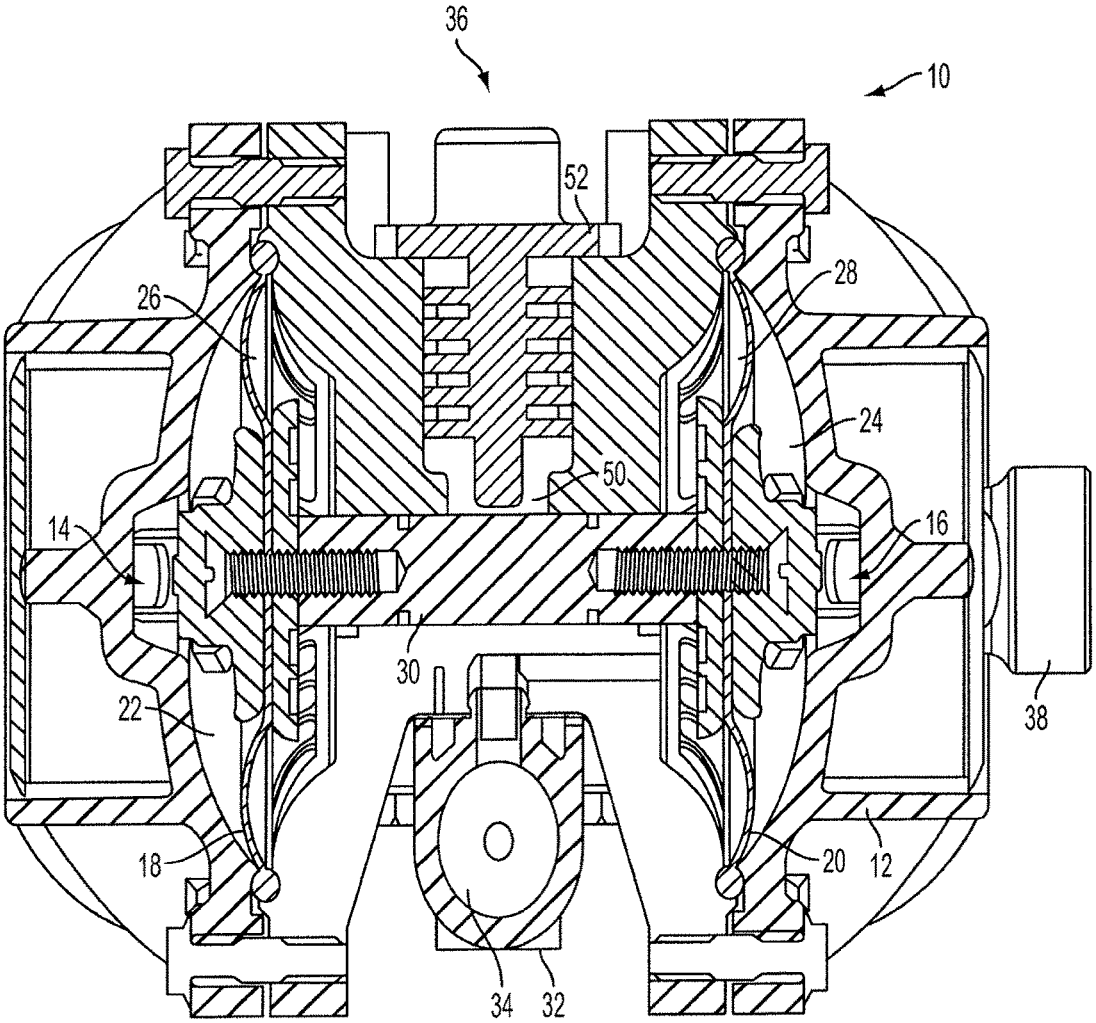
FIG. 2 is a cross-sectional view of the pump of FIG. 1, taken along the line 2-2 in FIG. 1.

Referring now to FIGS. 1 and 2, one illustrative embodiment of a diaphragm pump 10 is shown. The pump 10 of FIGS. 1 and 2 is illustratively embodied as an air-operated double diaphragm pump. It is contemplated that, in other embodiments, the pump 10 might be embodied as another type of diaphragm pump (or even another type of positive displacement pump). In the illustrative embodiment, the pump 10 has a housing 12 that defines a cavity 14 and a cavity 16. The housing 12 is illustratively comprised of three sections coupled together by fasteners. As best seen in FIG. 2, the cavities 14, 16 of the pump 10 are each separated by a respective flexible diaphragm 18, 20 into a respective pumped media chamber 22, 24 and a respective motive fluid chamber 26, 28. The diaphragms 18, 20 are interconnected by a shaft 30, such that when the diaphragm 18 is moved to increase the volume of the associated pumped media chamber 22, the other diaphragm 20 is simultaneously moved to decrease the volume of the associated pumped media chamber 24, and vice versa.

The shaft 30 illustrated in FIG. 2 is a reciprocating diaphragm link rod having a fixed length, such that the diaphragms 18, 20 move reciprocally together with the shaft 30. The shaft 30 and diaphragms 18, 20 move back and forth a fixed distance that defines a stroke. The fixed distance is determined by the geometry of the pump 10, the shaft 30, the diaphragms 18, 20, and other components of the pump 10. A stroke is defined as the travel path of the shaft 30 between end-of-stroke positions. Movement of the shaft 30 from one end-of-stroke position to the other end-of-stroke position and back defines a cycle of operation of the shaft 30 (i.e., a cycle includes two consecutive strokes).

The pump 10 includes an inlet 32 for the supply of a compressed fluid (e.g., compressed air, another pressurized gas, hydraulic fluid, etc.) and a main valve 34 for alternately supplying the compressed fluid to the motive fluid chambers 26, 28 to drive reciprocation of the diaphragms 18, 20 and the shaft 30. The main valve 34 is fluidly coupled between the inlet 32 and the motive fluid chambers 26, 28. When the main valve 34 supplies compressed fluid to the motive fluid chamber 26 (while in a position 60), the main valve 34 places an exhaust assembly 36 in communication with the other motive fluid chamber 28 to permit fluid to be expelled therefrom. Conversely, when the main valve 34 supplies compressed fluid to the motive fluid chamber 28 (while in a position 61), the main valve 34 places the motive fluid chamber 26 in communication with the exhaust assembly 36. In the illustrative embodiment of the pump 10, movement of the main valve 34 between the positions 60, 61 is controlled by a pilot valve 35 (shown diagrammatically in FIGS. 5-7). As such, by controlling movement of the main valve 34, the pilot valve 35 of the pump 10 controls the supply of compressed fluid to the motive fluid chambers 26, 28.

Figure 5:
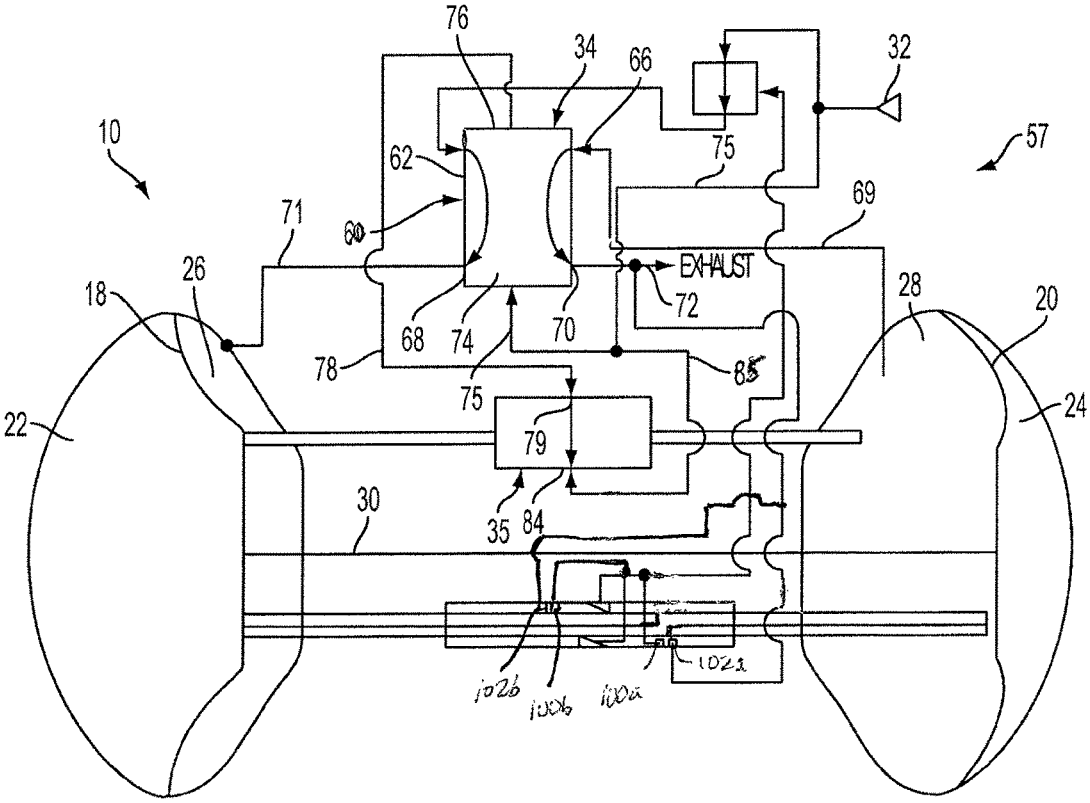
FIG. 5 is a diagrammatic view of the pump of FIG. 1 during yet another operating stage.
Figure 6:
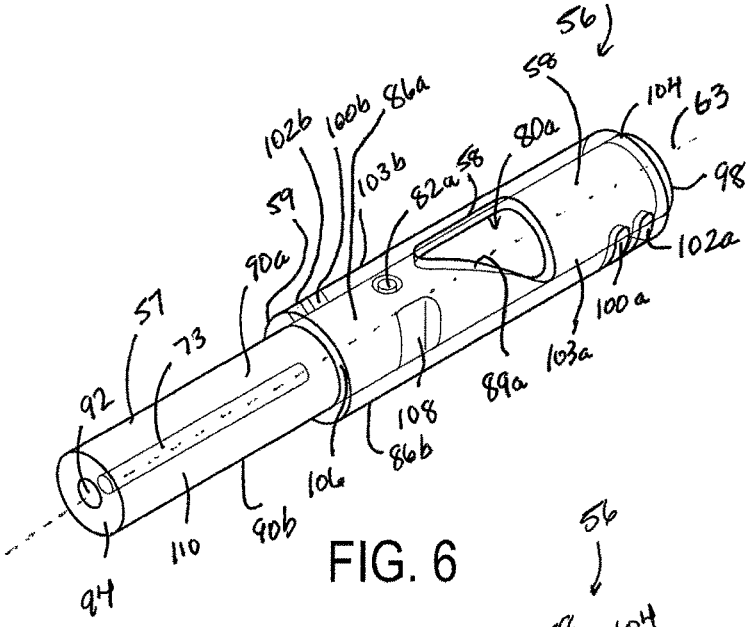
FIG. 6 is a perspective view of an air savings device of the pump of FIG. 1 during one operating stage.
Figure 7:
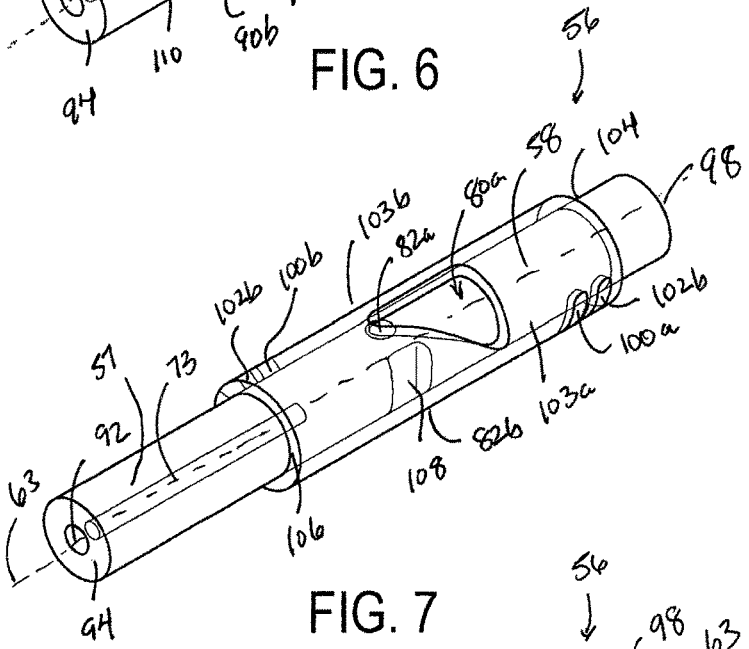
FIG. 7 is a perspective view of an air savings device of FIG. 6 during another operating stage.

As seen in FIGS. 5-7, the pilot valve 35 is illustratively embodied as a directional control valve having a spool 42 movable between a plurality of positions to selectively fluidly couple a plurality of ports formed in the pilot valve 35 to one another. The pilot valve 35 is positioned between the cavities 14, 16 such that the spool 42 extends into each of the cavities 14, 16, as shown in FIGS. 5-7. As the diaphragms 18, 20 move in unison with the shaft 30 between the end-of-stroke positions, the diaphragms alternately contact the spool 42, causing the spool 42 to move between its positions such that the pilot valve 35 either communicates compressed fluid to a pilot chamber 76 of the main valve 34 or exhausts the pilot chamber 76 to the exhaust assembly 36.

The exhaust assembly 36 of the pump 10 includes an exhaust chamber 50 and a muffler 52 that is received in the exhaust chamber 50. In the illustrative embodiment, the main valve 34 alternately couples one of the motive fluid chambers 26, 28 (whichever of the motive fluid chambers 26, 28 is not being supplied with compressed fluid by the main valve 34) to the exhaust assembly 36 to allow any fluid in that motive fluid chamber 26, 28 to be vented to the atmosphere. It is contemplated that, in other embodiments, the pump 10 might use other mechanisms to selectively couple the motive fluid chambers 26, 28 to the exhaust assembly 36 (e.g., "quick dump check valves" positioned between the main valve 34 and the motive fluid chambers 26, 28).

During operation of the pump 10, as the main valve 34, the pilot valve 35, and the exhaust assembly 36 cooperate to effect the reciprocation of the diaphragms 18, 20 and the shaft 30, the pumped media chambers 22, 24 alternately expand and contract to create respective low and high pressure within the respective pumped media chambers 22, 24. The pumped media chambers 22, 24 each communicate with a pumped media inlet 38 that may be connected to a source of fluid to be pumped (also referred to herein as "pumped media") and also each communicate with a pumped media outlet 40 that may be connected to a receptacle for the fluid being pumped. Check valves (not shown) ensure that the fluid being pumped moves only from the pumped media inlet 38 toward the pumped media outlet 40. For instance, when the pumped media chamber 22 expands, the resulting negative pressure draws fluid from the pumped media inlet 38 into the pumped media chamber 22. Simultaneously, the other pumped media chamber 24 contracts, which creates positive pressure to force fluid contained therein to the pumped media outlet 40. Subsequently, as the shaft 30 and the diaphragms 18, 20 move in the opposite direction, the pumped media chamber 22 will contract and the pumped media chamber 24 will expand (forcing fluid contained in the pumped media chamber 24 to the pumped media outlet 40 and drawing fluid from the pumped media inlet 38 into the pumped media chamber 24).

Figure 3:
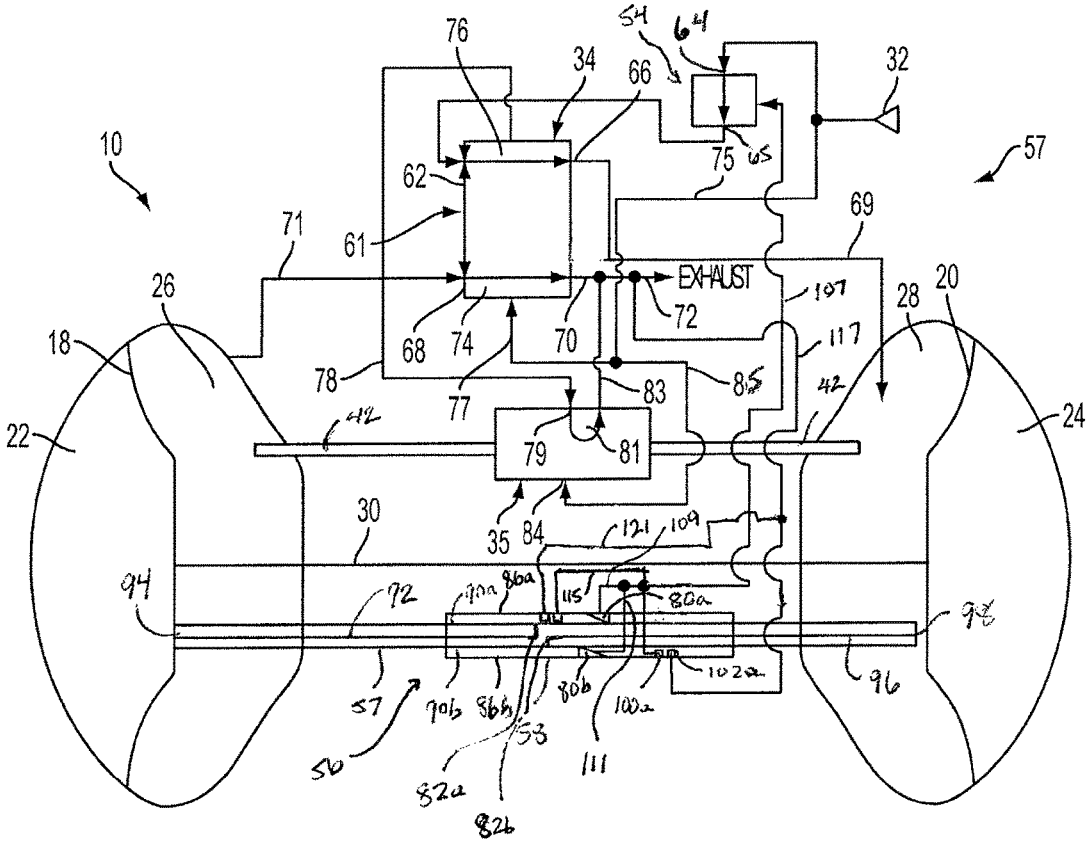
FIG. 3 is a diagrammatic view of the pump of FIG. 1 during one operating stage.
Figure 4:
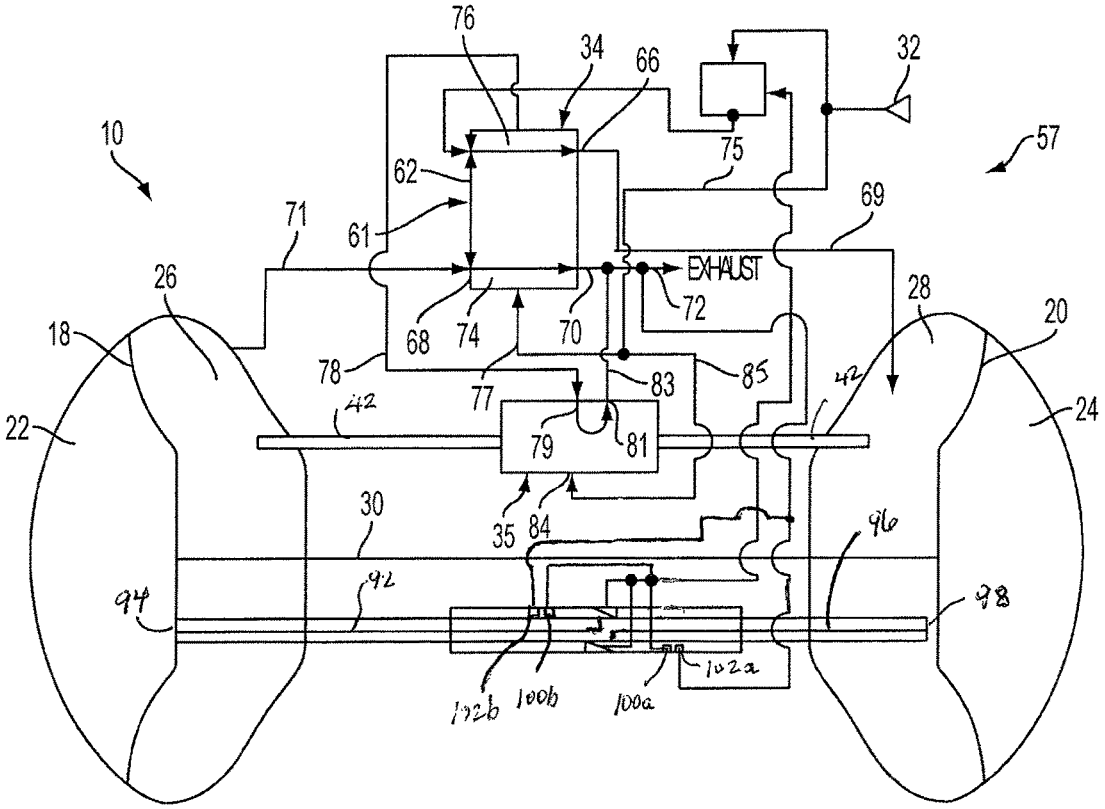
FIG. 4 is a diagrammatic view of the pump of FIG. 1 during another operating stage.

Referring now to FIGS. 3-5, the shaft 30 and the diaphragms 18, 20 are shown diagrammatically in various positions during a stroke of the pump 10. Specifically, the shaft 30 and the diaphragms 18, 20 are shown near a left end-of-stroke position (FIG. 3), mid-stroke (FIG. 4), and in a right end-of-stroke position (FIG. 5). Fluid connections between components included in the pump 10 are generally depicted by lines, and the directions of compressed fluid flow between the components of the pump 10 are generally indicated by arrowheads on those lines.

As seen in FIGS. 3-5, a cut-off valve 54 is fluidly coupled between the inlet 32 and the main valve 34. The cut-off valve 54 is configured to selectively resist communication of compressed fluid from the inlet 32 to the main valve 34 (and, hence, to either of the motive fluid chambers 26, 28) in response to receiving a particular pilot signal. As described in more detail below, this pilot signal is supplied by an air savings device 56 that includes a spool 57 and a sleeve 58. One of the spool 57 and the sleeve 58 is rotatable relative to the other of the spool 57 and the sleeve 58 to adjust at least one "turndown" position at which the air savings device 56 supplies the particular pilot signal to the cut-off valve 54.

Referring now to FIG. 3, the main valve 34 supplies compressed fluid to the motive fluid chamber 28 as the shaft 30 and the diaphragms 18, 20 move away from the one end-of-stroke position and toward the other end-of-stroke position. Specifically, compressed fluid is communicated from the inlet 32 to a port 64 of the cut-off valve 54, from the port 64 to a port 65 of the cut-off valve 54 fluidly coupled to the port 64, from the port 65 to a port 62 of the main valve 34 via a conduit 67, from the port 62 to a port 66 of the main valve 34 fluidly coupled to the port 62, and from the port 66 to the motive fluid chamber 28 via a conduit 69. Additionally, the main valve 34 vents any fluid contained in the motive fluid chamber 26 to the exhaust assembly 36 as shown in FIG. 3. Specifically, compressed fluid is communicated from the motive fluid chamber 26 to a port 68 of the main valve 34 via a conduit 71, from the port 68 to a port 70 of the main valve 34 fluidly coupled to the port 68, and from the port 70 to the exhaust assembly 36 via a conduit 72.

The main valve 34 is shown in the position 61 in FIG. 3. In the position 61, as well as the position 60 and all other positions of the main valve 34 between the positions 60, 61, compressed fluid is communicated from the inlet 32 to a pressure chamber 74 of the main valve 34 via conduits 75, 77. Compressed fluid is illustratively communicated to the pressure chamber 74 at a constant pressure. A pressure regulator (not shown) may be fluidly coupled between the inlet 32 and the pressure chamber 74 to regulate the compressed fluid pressure communicated to the pressure regulator so that the constant compressed fluid pressure is communicated to the pressure chamber 74. In some embodiments, the constant compressed fluid pressure communicated to the pressure chamber 74 is of a smaller magnitude than the compressed fluid pressure supplied from the inlet 32. In other embodiments, compressed fluid at a variable pressure may be communicated to the pressure chamber 74.

In any case, the pilot chamber 76 of the main valve 34 positioned opposite the pressure chamber 74 is fluidly coupled to the exhaust assembly 36 in the position 61 to communicate compressed fluid contained in the pilot chamber 76 to the exhaust assembly 36 as shown in FIG. 3 (i.e., so the pressure in the pilot chamber 76 is approximately at atmospheric pressure). Specifically, compressed fluid in the pilot chamber 76 is communicated to a port 79 of the pilot valve 35 via conduit 80, from the port 79 to a port 81 of the pilot valve 35 fluidly coupled to the port 79, and from the port 81 to the exhaust assembly 36 via conduits 83, 72. The pilot valve 35 is used to control the pressure differential between the pressure chamber 74 and the pilot chamber 76 of the main valve 34 to cause the main valve 34 to move between the positions 60, 61.

The spool 42 of the pilot valve 35 extends into each of the motive fluid chambers 26, 28 as shown in FIG. 3. The spool 42 of the pilot valve 35 is spaced apart from each of the diaphragms 18, 20 such that the port 79 is fluidly coupled to the port 81 and communication between a port 84 of the pilot valve 35 and the port 79 is resisted. The port 84 receives compressed fluid pressure from the inlet 32 via conduits 75, 85. As shown in FIG. 3, the pilot valve 35 fluidly couples the pilot chamber 76 to atmospheric pressure through the exhaust assembly 36. As shown in FIG. 5, the pilot valve 35 fluidly couples the pilot chamber 76 to compressed fluid pressure communicated to the port 84 when the main valve 34 is in the position 60.

The cut-off valve 54 is fluidly coupled to the inlet 32, the main valve 34, and the air savings device 56 as shown in FIG. 3. The cut-off valve 54 is illustratively embodied as a normally-closed valve that fluidly couples the inlet 32 to the main valve 34. As such, the cut-off valve 54 is also configured to communicate compressed fluid from the inlet 32 to the motive fluid chamber 28 through the main valve 34. More specifically, the cut-off valve 54 is configured to communicate compressed fluid from the inlet 32 to the motive fluid chamber 28 prior to a particular pilot signal being supplied to the cut-off valve 54 (see FIG. 3), or once a different pilot signal is supplied to the cut-off valve 54 from the air savings device 56 (see FIG. 5).

The air savings device 56 extends into each of the motive fluid chambers 26, 28 such that the spool 57 contacts the diaphragm 18 and is spaced-apart from the diaphragm 20 as shown in FIG. 3. When the shaft 30 and the diaphragms 18, 20 move from the one end-of-stroke position toward the other end-of-stroke position as shown in FIGS. 3-5, the spool 57 moves with the diaphragm 18 and slides relative to the sleeve 58. Once the shaft 30 and the diaphragms 18, 20 attain the other end-of-stroke position and begin to move back toward the one end-of-stroke position, the spool 57 contacts the diaphragm 20 and is spaced-apart from the diaphragm 18.

With reference to FIGS. 3 and 6, the air savings device 56 is shown inside the pump 10 as indicated above (see FIG. 3) and outside the pump 10 (see FIG. 6). In each of FIGS. 3 and 6, the spool 57 is shown supported in a bore 59 formed in the sleeve 58. The bore 59 extends along a longitudinal axis 63, and the spool 57 is configured to slide relative to the sleeve 58 along the longitudinal axis 63 when the air savings device 56 is positioned inside the pump 10. When positioned within the housing 12 of the pump 10, the sleeve 58 may be supported such that the sleeve 58 is rotatable about the longitudinal axis 63. In some embodiments, the spool 57 may be constrained from rotating with the sleeve 58 about the longitudinal axis 63 when the air savings device 56 is positioned inside the housing 12. For example, the housing 12 may be formed to include a keyed feature (not shown), and the spool 57 may be formed to include a keyed feature 73 complementary to the keyed feature of the housing 12. The keyed feature of the housing 12 and the keyed feature 73 are configured to mate with one another to resist rotation of the spool 57 about the longitudinal axis 63. In other embodiments, the spool 57 may be rotatable about the axis 63, and the sleeve 58 may be constrained from rotating with the spool 57 about the axis 63 when the air savings device 56 is positioned inside the housing 12.

Referring again to FIGS. 3 and 6, the sleeve 58 is formed to include a sleeve port 80*a* that opens into the bore 59 through a segment 86*a* of the sleeve 58, and a sleeve port 80*b* that opens into the bore 59 through a segment 86*b* of the sleeve 58 opposite the segment 86*a*. The sleeve ports 80*a*, 80*b* are substantially identical, except that portions of the sleeve ports 80*a*, 80*b* are spaced apart from one another along the length of the sleeve 58 as shown in FIGS. 3 and 6. The sleeve ports 80*a*, 80*b* includes sidewalls 89*a*, 89*b*, respectively, disposed at acute angles to the circumference of the sleeve 58. Additionally, the spool 57 is formed to include a spool port 82*a* that extends through a segment 90*a* of an outer surface 110 of the spool 57, and a spool port 82*b* that extends through a segment 90*b* of the outer surface 110 opposite the segment 90*a*. The spool ports 82*a*, 82*b* are substantially identical, except that portions of the spool ports 82*a*, 82*b* are spaced apart from one another along the length of the spool 57 as shown in FIGS. 3 and 6.

As best seen in FIGS. 3-5, the spool 57 is formed to include a passageway 92 extending parallel to the longitudinal axis 63 between the spool port 82*a* and an end 94 of the spool 57 that contacts the diaphragm 18. The spool 57 is also forming to include a passageway 96 extending parallel to the longitudinal axis 63 between the spool port 82*b* and an end 98 of the spool 57 opposite the end 94. The passageways 92, 96 are not fluidly coupled to one another, and no compressed fluid is communicated between the passageways 92, 96 during operation of the pump 10. The passageway 92 is configured to fluidly couple the motive fluid chamber 26 to the spool port 82*a* at least momentarily when compressed fluid is supplied to the motive fluid chamber 26 in a turndown position as suggested in FIG. 5. The passageway 96 is configured to fluidly couple the motive fluid chamber 28 to the spool port 82*b* at least momentarily when compressed fluid is supplied to the motive fluid chamber 28 in a second turndown position as suggested in FIG. 3.

The spool ports 82*a*, 82*b* are spaced apart from the sleeve ports 80*a*, 80*b* as shown in FIG. 3. As the shaft 30 and the diaphragms 18, 20 move toward the pumped media chamber 24, engagement between the spool 57 and the diaphragm 18 causes the spool 57 to slide through the bore 59 of the sleeve 58, thereby advancing the spool ports 82*a*, 82*b* toward the sleeve ports 80*a*, 80*b*. As discussed below with regard to FIG. 4, the spool port 82*b* and the sleeve port 80*b* align at the second turndown position which causes the pilot signal to be supplied to the cut-off valve 54.

Again referencing FIGS. 3 and 6, the sleeve 58 is formed to include sleeve ports 100*a*, 102*a* that each open into the bore 59 through a segment 103*a* of the sleeve 58. Additionally, the sleeve 58 is formed to include sleeve ports 100*b*, 102*b* that each open into the bore 59 through a segment 103*b* of the sleeve 58 opposite the segment 103*a*. The sleeve ports 100*a*, 102*a* are positioned between the sleeve ports 80*a*, 80*b* and an end 104 of the sleeve 58, and the sleeve ports 100*b*, 102*b* are positioned between the sleeve ports 80*a*, 80*b* and an end 106 of the sleeve 58 opposite the end 104. The sleeve port 100*b* is positioned in closer proximity to the sleeve ports 80*a*, 80*b* than the sleeve port 102*b*, and the sleeve port 100*a* is positioned in closer proximity to the sleeve ports 80*a*, 80*b*, than the sleeve port 102*a*. As discussed below with regard to FIG. 5, the sleeve ports 100*a*, 102*a* cooperate with a spool groove 108 formed in the spool 57 to fluidly couple the cut-off valve 54 to the exhaust assembly 36 to supply a pilot signal to the cut-off valve 54 when the shaft 30 and the diaphragms 18, 20 reach the other end-of-stroke position. Conversely, when the shaft 30 and the diaphragms 18, 20 move in the opposite direction to the one end-of-stroke position, the sleeve ports 100*b*, 102*b* cooperate with the spool groove 108 to fluidly couple the cut-off valve 54 to the exhaust assembly 36 to again supply a pilot signal to the cut-off valve 54.

Figure 8:
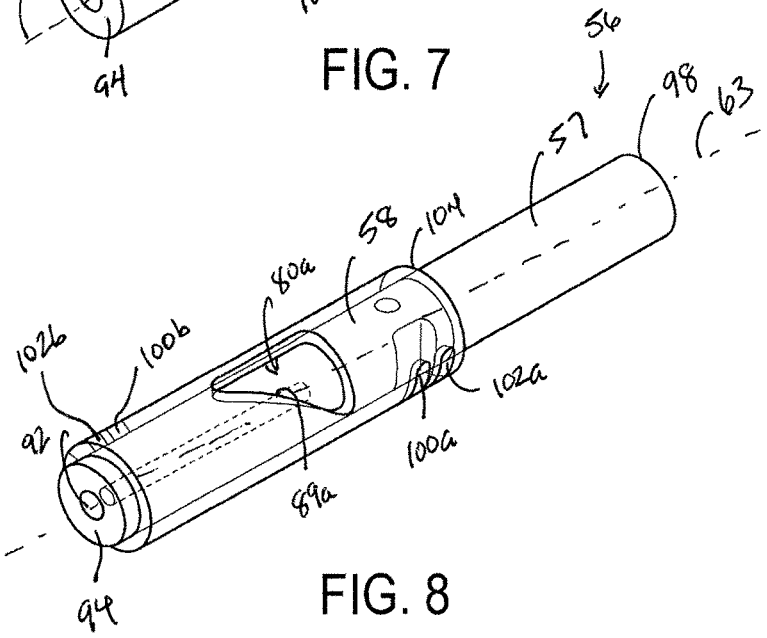
FIG. 8 is a perspective view of an air savings device of FIG. 6 during yet another operating stage.

The spool groove 108 is formed in the outer surface 110 of the spool 57 as best seen in FIGS. 6-8. The spool groove 108 is spaced apart from the spool ports 82*a*, 82*b* along the outer surface 110, and the spool groove 108 is positioned substantially midway between the ends 94, 98 of the spool 57. The spool groove 108 fluidly couples the sleeve ports 100*a*, 102*a* to one another to supply a pilot signal to the cut-off valve 54 as indicated above when the shaft 30 reaches the other end-of-stroke position. Similarly, the spool groove 108 fluidly couples the sleeve ports 100*b*, 102*b* to one another to supply a pilot signal to the cut-off valve 54 as indicated above when the shaft 30 reaches the one end-of-stroke position.

As seen in FIGS. 3-5, each of the sleeve ports 80*a*, 80*b* is fluidly coupled to the cut-off valve 54. Specifically, the sleeve port 80*a* is fluidly coupled to the cut-off valve 54 via conduits 107, 109, and the sleeve port 80*b* is fluidly coupled to the cut-off valve 54 via conduits 107, 109, 111. The fluid connection between the sleeve port 80*a* and the cut-off valve 54 (i.e., through conduits 107, 109) and between the sleeve port 80*b* and the cut-off valve 54 (i.e., through conduits 107, 109, 111) may be achieved through the use of a single fluid line (i.e., for each of the sleeve ports 80*a*, 80*b*), which is referred to herein as a pilot line. Each of the sleeve ports 100*a* and 100*b* is also fluidly coupled to the cut-off valve 54. Specifically, the sleeve port 100*a* is fluidly coupled to the cut-off valve 54 via conduits 107, 113, and the sleeve port 100*b* is fluidly coupled to the cut-off valve 54 via conduits 107, 115. Each of the sleeve ports 102*a* and 102*b* is fluidly coupled to the exhaust assembly 36. Specifically, the sleeve port 102*a* is fluidly coupled to the exhaust assembly 36 via conduits 117, 119, 72, and the sleeve port 102*b* is fluidly coupled to the exhaust assembly 36 via conduits 117, 121, 72.

Referencing FIGS. 3 and 6 yet again, the positioning of the spool 57 relative to the sleeve 58 as shown in FIG. 3 (i.e., while the air savings device 56 is positioned inside the housing 12) is approximated in FIG. 6 (i.e., while the air savings device 56 is positioned outside the housing 12). The spool 57 has not yet advanced through the bore 59 such that the spool port 82*b* and the sleeve port 80*b* are aligned. As such, the shaft 30 and the diaphragms 18, 20 have not yet reached the second turndown position, and the pilot signal has yet to be supplied to the cut-off valve 54.

With reference to FIGS. 4 and 7, the positioning of the spool 57 relative to the sleeve 58 as shown in FIG. 4 (i.e., while the air savings device 56 is positioned inside the housing 12) is approximated in FIG. 7 (i.e., while the air savings device 56 is positioned outside the housing 12). The shaft 30 and the diaphragms 18, 20 have reached the second turndown position such that the spool port 82*b* is aligned with the sleeve port 80*b*. Since the end 98 of the spool 57 is spaced apart from the motive fluid chamber 28 (see FIG. 4), compressed fluid supplied to the motive fluid chamber 28 flows to the spool port 82*b* via the passageway 96. Alignment of the spool port 82*b* and the sleeve port 80*b* causes compressed fluid to be communicated to the cut-off valve 54 via the pilot line.

The pilot signal described herein may illustratively include compressed fluid pressure communicated to the cut-off valve 54 via the pilot line. In the illustrative embodiment, the cut-off valve 54 resists communication of compressed fluid from the inlet 32 to the motive fluid chamber 28 in response to receiving the pilot signal. Movement of the normally-open cut-off valve 54 to a closed position (which resists communication of compressed fluid from the inlet 32 to the motive fluid chamber 28) may be based on the pressure of the compressed fluid communicated to the cut-off valve 54 from the pilot line. In the illustrative embodiment, the cut-off valve 54 moves to the open position when the pressure of the pilot signal exceeds a threshold. In other embodiments, the cut-off valve 54 may move to the open position when the pressure of the pilot signal falls below a threshold.

As indicated above, the turndown position (i.e., the position where the spool port 82*b* aligns with the sleeve port 80*b* or the spool port 82*a* aligns with the sleeve port 80*a*) at which the air savings device 56 supplies a pilot signal to the cut-off valve 54 is adjustable. Specifically, by rotating the sleeve 58 relative to the spool 57, the spacing between the ports 82*b*, 80*b* and the sleeve ports 82*a*, 80*a* may be increased to increase the distance that the shaft 30 and the diaphragms 18, 20 move between the end-of-stroke positions before the turndown position is reached, or decreased to decrease the distance that the shaft 30 and the diaphragms 18, 20 move between the end-of-stroke positions before the turndown position is reached.

With reference to FIGS. 5 and 8, the positioning of the spool 57 relative to the sleeve 58 as shown in FIG. 5 (i.e., while the air savings device 56 is positioned inside the housing 12) is approximated in FIG. 8 (i.e., while the air savings device 56 is positioned outside the housing 12). The pilot valve 35 contacts the diaphragm 18 to cause the main valve 34 to move from the position 61 to the position 60, thereby causing compressed fluid from the inlet 32 to be communicated to the motive fluid chamber 26 while compressed fluid contained in the motive fluid chamber 28 is vented through the main valve 34 to the exhaust assembly 36. As such, the shaft 30 and the diaphragms 18, 20 are shown in the other end-of-stroke position in FIGS. 5 and 8.

In the other end-of-stroke position shown in FIGS. 5 and 8, the groove 108 formed in the spool 57 aligns with each of the sleeve ports 100*a*, 102*a*. The groove 108 fluidly couples the sleeve ports 100*a*, 102*a* to one another so that the compressed fluid communicated to the cut-off valve 54 is exhausted through the exhaust assembly 36. More specifically, compressed fluid flows from the cut-off valve 54 to the sleeve port 100*a* fluidly coupled to the cut-off valve 54, from the sleeve port 100*a* to the sleeve port 102*a* via the groove 108, and from the sleeve port 102*a* to the exhaust assembly 36. Exhausting of the cut-off valve 54 causes a pilot signal to be supplied to the cut-off valve 54 from the sleeve port 100*a* via the pilot line. The pilot signal illustratively includes fluid communicated to the cut-off valve 54 at approximately atmospheric pressure.

In response to receiving the pilot signal via the pilot line, the cut-off valve 54 opens to communicate compressed fluid from the inlet 32 to the motive fluid chamber 26 through the main valve 34. In the illustrative embodiment, the cut-off valve 54 closes in response to the pressure of the pilot signal falling below a threshold. In other embodiments, the cut-off valve 54 may close in response to the pressure of the pilot signal exceeding a threshold.

Up to this point, the turndown positions have been described as coinciding with the communication of one pilot signal to the cut-off valve 54, and the end-of-stroke positions have been described as coinciding with the communication of another pilot signal to the cut-off valve 54. It should be appreciated that in other embodiments, the compressed fluid pressures associated with the turndown and end-of-stroke positions may be reversed. More specifically, the initial pilot signal may include fluid at atmospheric pressure and the subsequent pilot signal may include compressed fluid pressure from one of the motive fluid chambers 26, 28. As such, fluid at atmospheric pressure may be communicated from one of the sleeve ports 80*a*, 80*b* to the cut-off valve 54 when one of the turndown positions is reached, and compressed fluid pressure from one of the motive fluid chambers 26, 28 may be communicated from one of the sleeve ports 100*a*, 100*b* to the cut-off valve 54 when one of the end-of-stroke positions is reached. In such embodiments, the pressure of the initial pilot signal may not exceed the threshold, and the pressure of the subsequent pilot signal may exceed the threshold.

Although the air savings device 56 is positioned in the housing 12 such that the air savings device 56 is spaced apart from and extends parallel to the shaft 30 as shown in FIGS. 3-5, it should be appreciated that in other embodiments, the shaft 30 may act as the sleeve 58, and the spool 57 may be positioned in a bore (not shown) extending through the shaft. The spool 57 may couple the diaphragms 18, 20 to one another so that the diaphragms 18, 20 reciprocate together between the end-of-stroke positions.

Figure 9:
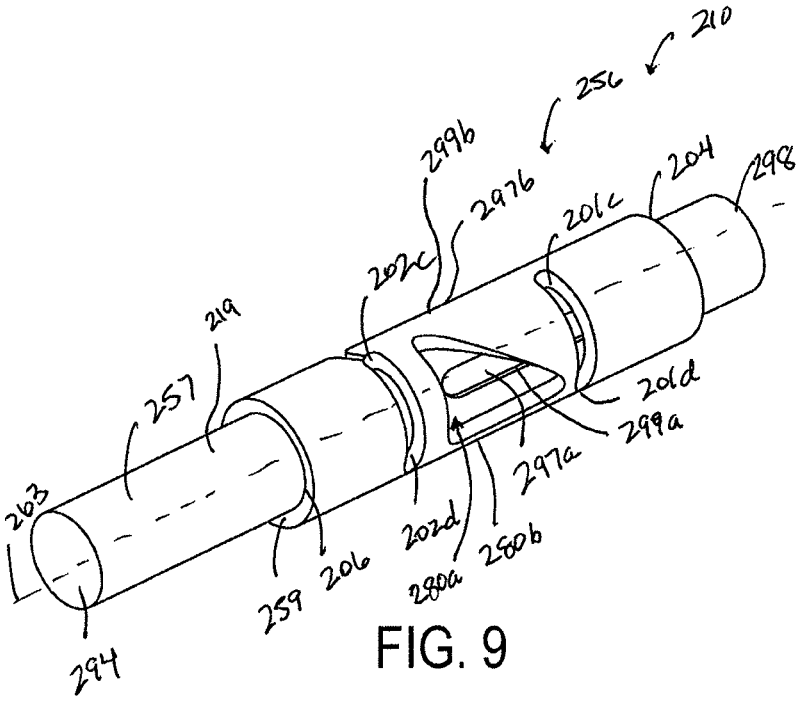
FIG. 9 is a perspective view of another illustrative embodiment of an air savings device for a diaphragm pump.

Referring now to FIG. 9, an air savings device 256 for use in a pump 210 is shown that is similar in many respects to the air savings device 56 used in the pump 10 shown in FIGS. 1-8 and described herein. Accordingly, similar reference numbers (in the 200 series in FIG. 9) indicate features that are similar in structure and operation between the air savings devices 56, 256 and the pumps 10, 210. The descriptions of the air savings device 56 and the pump 10 are hereby incorporated by reference to apply to the air savings device 256 and the pump 210, except in instances when it conflicts with the specific description and drawings of the air savings device 256 and the pump 210.

Unlike the spool 57 of the air savings device 56, the spool 257 of the air savings device 256 is not formed to include passageways extending through the ends 294, 298 of the spool 257. The spool 257 is formed to include grooves 297*a*, 297*b* in an outer surface 219 of the spool 257 that are positioned opposite of one another. The spool grooves 297*a*, 297*b* include sidewalls 299*a*, 299*b*, respectively, disposed at an acute angle to a circumference of the spool 57. Further unlike the sleeve 58 of the air savings device 56, the sleeve 258 of the air savings device 256 is formed to include single sleeve ports 201*c*, 201*d* opening into the bore 259 and positioned opposite of one another. The sleeve port 201*c* is positioned between the sleeve port 280*a* and the end 204 of the sleeve 258, and the sleeve port 201*d* is positioned between the sleeve port 280*b* and the end 204 of the sleeve 258. Further still unlike the sleeve 58 of the air savings device 56, the sleeve 258 of the air savings device 256 is formed to include single sleeve ports 202*c*, 202*d* opening into the bore 259 and positioned opposite of one another. The sleeve port 202*c* is positioned between the sleeve port 280*a* and the end 206 of the sleeve 258, and the sleeve port 202*d* is positioned between the sleeve port 280*b* and the end 206 of the sleeve 258.

When the air savings device 256 is installed in the pump 210, the sleeve ports 280*a*, 280*b* are fluidly coupled to the cut-off valve 254 via the pilot lines, the sleeve ports 201*c*, 201*d* are fluidly coupled to the inlet 232, and the sleeve ports 202*c*, 202*d* are fluidly coupled to the exhaust assembly 236. As the air savings device 256 moves with the diaphragms 218, 220 to a turndown position between the end-of-stroke positions, one of the spool grooves 297*a*, 297*b* fluidly couples one of the sleeve ports 201*c*, 201*d* to one of the sleeve ports 280*a*, 280*b* to cause a pilot signal to be supplied to the cut-off valve 254 via one of the pilot lines. Similar to the air savings device 56, the air savings device 256 permits the location of the turndown position to be adjusted. Specifically, at least one of the sleeve 258 and the spool 257 is rotatable about the longitudinal axis 263 to adjust the location of the turndown position relative to the end-of-stroke positions. Once the diaphragms 218, 220 reach the end-of-stroke positions, one of the spool grooves 297*a*, 297*b* fluidly couples one of the sleeve ports 202*c*, 202*d* to one of the sleeve ports 280*a*, 280*b* to cause another pilot signal to be supplied to the cut-off valve 254 via one of the pilot lines.

In the illustrative embodiment, the initial pilot signal supplied to the cut-off valve 254 comprises a pressure that exceeds the threshold of the cut-off valve 254 (i.e., similar to the cut-off valve 54). The subsequent pilot signal supplied to the cut-off valve 254 comprises a pressure that does not exceed the threshold of the cut-off valve 254 (i.e., similar to the cut-off valve 54).

In other embodiments, when the air savings device 256 is installed in the pump 210 as indicated above, the sleeve ports 201*c*, 201*d* may be coupled to the exhaust assembly 236 and the sleeve ports 202*c*, 202*d* may be coupled to the inlet 232. As such, the initial pilot signal supplied to the cut-off valve 254 comprises a pressure that does not exceed the threshold, and the subsequent pilot signal supplied to the cut-off valve 254 comprises a pressure that exceeds the threshold.

Figure 10:
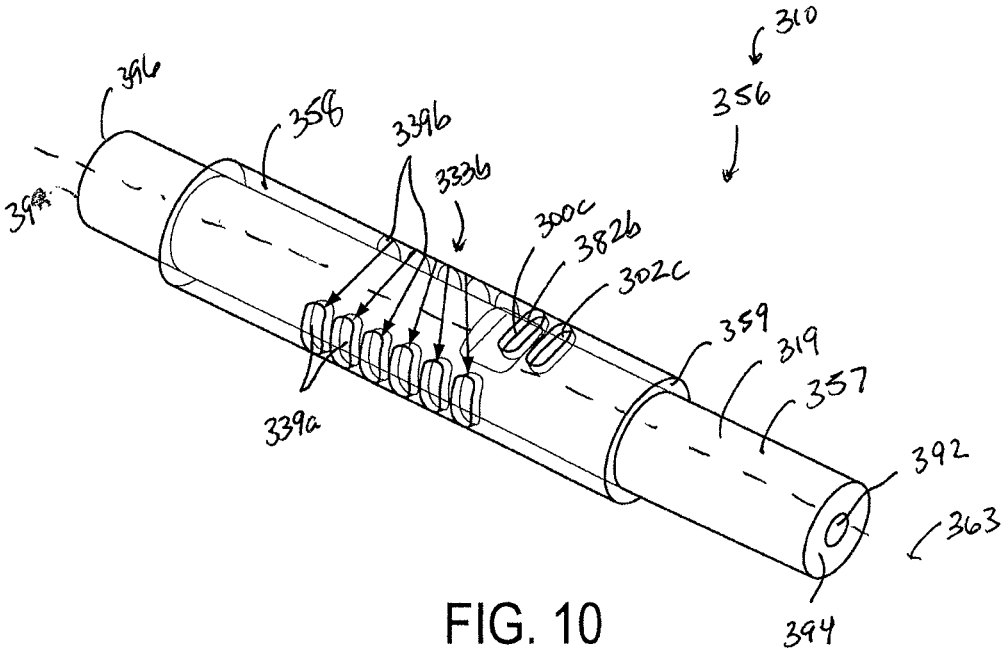
FIG. 10 is a perspective view of yet another illustrative embodiment of an air savings device for a diaphragm pump.

Referring now to FIG. 10, an air savings device 356 for use in a pump 310 is shown that is similar in many respects to the air savings device 56 used in the pump 10 shown in FIGS. 1-8 and described herein, and also to the air savings device 256 used in the pump 210 shown in FIG. 9 and described herein. Accordingly, similar reference numbers (in the 300 series in FIG. 10) indicate features that are similar in structure and operation between the air savings devices 56, 256, 356 and the pumps 10, 210, 310. The descriptions of the air savings device 56 and the pump 10, as well as the air savings device 256 and the pump 210, are hereby incorporated by reference to apply to the air savings device 356 and the pump 310, except in instances when it conflicts with the specific description and drawings of the air savings device 356 and the pump 310.

As shown in FIG. 10, the sleeve 358 of the air savings device 356 is formed to include a plurality of sleeve ports 333*a* spaced apart from one another along the longitudinal axis 363. The sleeve 358 is also formed to include a plurality of sleeve ports 333*b* spaced apart from one another along the longitudinal axis 363 and positioned opposite the sleeve ports 333*a*. Each of the ports 333*a*, 333*b* opens into the bore 359 as shown in FIG. 10. The sleeve 358 is further formed to include sleeve ports 300*c*, 300*d* positioned opposite one another and sleeve ports 302*c*, 302*d* positioned opposite one another.

The spool 357 of the air savings device 356 is formed to include spool ports 382*a*, 382*b* positioned opposite one another in the outer surface 319 as suggested in FIG. 10. Similar to the spool 57 of the air savings device 56, the spool 357 is formed to include the passageway 392 extending along the axis 363 through the end 394 of the spool 357 and the passageway 396 extending along the axis 363 through the opposite end 398 of the spool 357.

When the air savings device 356 is installed in the pump 310, the sleeve ports 300*c*, 300*d* are fluidly coupled to the pilot lines of the cut-off valve 354, and the sleeve ports 302*c*, 302*d* are fluidly coupled to the exhaust assembly 336. A selected one of the plurality of ports 333*a* is configured to provide fluid communication between the bore 359 and the pilot line via the sleeve port 300*c* (i.e., as the diaphragms 318, 320 move toward one end-of-stroke position), and a selected one of the ports 333*b* is configured to provide fluid communication between the bore 359 and the pilot line via the sleeve port 300*d* (i.e., as the diaphragms 318, 320 move toward the other of end-of-stroke position). For each of the pluralities of ports 333*a*, 333*b*, all but the selected one of the plurality of ports 333*a*, 333*b* are blocked to resist fluid communication between the bore 359 and the pilot lines.

As the spool 357 of the air savings device 356 moves with the diaphragms 318, 320 to a turndown position located between the one end-of-stroke position and the other end-of-stroke position, one of the spool ports 382*a*, 382*b* aligns with the selected one of one of the pluralities of sleeve ports 333*a*, 333*b* to cause the initial pilot signal to be supplied to the cut-off valve 354 via one of the pilot lines. The location of the turndown position relative to the one end-of-stroke position and the other end-of-stroke position is dependent upon which one of the pluralities of sleeve ports 333*a*, 333*b* is selected.

As shown in FIG. 10, a plurality of removable plugs 339*a* are positioned in all but the selected one of the sleeve ports 333*a*. A plurality of removable plugs 339*b* may be positioned in all but the selected one of the sleeve ports 333*b*. In other embodiments, a manifold (not shown) slidable relative to the sleeve 358 along the longitudinal axis 363 may be configured to cover all but the selected one of the sleeve ports 333*a* and all but the selected one of the sleeve ports 333*b*.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A diaphragm pump comprising:

a first diaphragm that separates a first cavity into a first motive fluid chamber and a first pumped media chamber, the first diaphragm being configured to stroke from a first end-of-stroke position to a second end-of-stroke position in response to compressed fluid being communicated from a compressed fluid inlet to the first motive fluid chamber;

a cut-off valve configured to (i) communicate compressed fluid from the compressed fluid inlet to the first motive fluid chamber in response to receiving a first pilot signal and (ii) resist communication of compressed fluid from the compressed fluid inlet to the first motive fluid chamber in response to receiving a second pilot signal;

a sleeve formed to include (i) a bore extending along a longitudinal axis and (ii) a first sleeve port that opens to the bore, the first sleeve port being fluidly coupled to the cut-off valve via a pilot line; and a spool supported in the bore of the sleeve and formed to include a first spool port, the spool being configured to move with the first diaphragm during at least a portion of the stroke of the first diaphragm such that the spool slides relative to the sleeve and, when the first diaphragm reaches a turndown position that is between the first and second end-of-stroke positions, the first spool port aligns with the first sleeve port to cause the second pilot signal to be supplied to the cut-off valve via the pilot line;

wherein at least one of the sleeve and the spool is rotatable about the longitudinal axis to adjust a location of the turndown position relative to the first and second end-of-stroke positions;

the sleeve is further formed to include (i) a second sleeve port that opens to the bore and (ii) a third sleeve port that opens to the bore, the third sleeve port being fluidly coupled to the pilot line;

the spool is further foil led to include a spool groove in an outer surface of the spool;

the spool is also configured to move with the first diaphragm during at least a portion of the stroke of the first diaphragm such that, when the first diaphragm reaches the second end-of-stroke position, the spool groove fluidly couples the second sleeve port to the third sleeve port to cause the first pilot signal to be supplied to the cut-off valve via the pilot line;

the spool is further formed to include a passageway extending along the longitudinal axis between the first spool port and an end of the spool that extends into the first motive fluid chamber, such that the first spool port is fluidly coupled to the first motive fluid chamber at least when the first diaphragm is in the turndown position;

the second sleeve port is fluidly coupled to an exhaust chamber;

the first pilot signal comprises a pressure that does not exceed a threshold; and the second pilot signal comprises a pressure that exceeds the threshold.

2. The diaphragm pump of claim 1, wherein the first spool port is fluidly coupled to the exhaust chamber at least when the first diaphragm is in the turndown position, and the second sleeve port is fluidly coupled to the compressed fluid inlet.

3. The diaphragm pump of claim 1, further comprising a second diaphragm that separates a second cavity into a second motive fluid chamber and a second pumped media chamber, the second diaphragm being coupled to the first diaphragm such that the second diaphragm is configured to move reciprocally with the first diaphragm between the first and second end-of-stroke positions, the second diaphragm further being configured to stroke from the second end-of-stroke position to first end-of-stroke position in response to compressed fluid being communicated from the compressed fluid inlet to the second motive fluid chamber;

wherein the second sleeve port opens to the bore, the second sleeve port being fluidly coupled to the cut-off valve via the pilot line; and wherein the spool is further formed to include a second spool port, the spool also being configured to move with the second diaphragm during at least a portion of the stroke of the second diaphragm such that the spool slides relative to the sleeve and, when the second diaphragm reaches the turndown position that is between the first and second end-of-stroke positions, the second spool port aligns with the second sleeve port to cause the second pilot signal to be supplied to the cut-off valve via the pilot line.

4. The diaphragm pump of claim 3, wherein the spool couples the second diaphragm to the first diaphragm such that the second diaphragm is configured to move reciprocally with the first diaphragm between the first and second end-of-stroke positions.

5. The diaphragm pump of claim 3, further comprising a shaft that couples the second diaphragm to the first diaphragm such that the second diaphragm is configured to move reciprocally with the first diaphragm between the first and second end-of-stroke positions, wherein the spool extends parallel to the shaft.

6. The diaphragm pump of claim 5, wherein:

the second diaphragm engages the spool during at least a portion of the stroke of the first diaphragm to cause the spool to slide relative to the sleeve; and the first diaphragm engages the spool during at least a portion of the stroke of the second diaphragm to cause the spool to slide relative to the sleeve.

7. The diaphragm pump of claim 3, wherein the spool is further formed to include:

a second passageway extending along the longitudinal axis between the second spool port and a second end of the spool that extends into the second motive fluid chamber, such that the second spool port is fluidly coupled to the second motive fluid chamber at least when the first and second diaphragms are in the turndown position.

8. The diaphragm pump of claim 1, wherein the first sleeve port is fluidly coupled to the exhaust chamber, and the third sleeve port is fluidly coupled to the compressed fluid inlet.

* * * * *